United States Patent [19]

Kandatsu et al.

[11] Patent Number: 4,622,444

[45] Date of Patent: Nov. 11, 1986

[54] CIRCUIT BREAKER HOUSING AND ATTACHMENT BOX

[75] Inventors: Kiyoshi Kandatsu; Naoshi Uchida; Nobuo Asahi, all of Saitama, Japan

[73] Assignee: Fuji Electric Co., Ltd., Kawasaki, Japan

[21] Appl. No.: 703,316

[22] Filed: Feb. 20, 1985

[30] Foreign Application Priority Data

Jul. 20, 1984 [JP] Japan ..... 59-151805

[51] Int. Cl.[4] ..... H01H 9/02

[52] U.S. Cl. ..... 200/303; 335/132

[58] Field of Search ..... 200/303, 307; 335/13, 335/132

[56] References Cited

U.S. PATENT DOCUMENTS

| | | | |
|---|---|---|---|
| 3,602,852 | 8/1971 | Brackett | 200/303 |
| 4,345,225 | 8/1982 | Lemmer | 335/132 |

FOREIGN PATENT DOCUMENTS

| | | | |
|---|---|---|---|
| 1590618 | 4/1970 | Fed. Rep. of Germany | 335/132 |
| 86537 | 8/1978 | Japan . | |
| 86538 | 8/1978 | Japan . | |
| 11062 | 3/1983 | Japan . | |
| 11063 | 3/1983 | Japan . | |
| 14508 | 3/1983 | Japan . | |
| 23161 | 5/1983 | Japan . | |
| 24362 | 5/1983 | Japan . | |
| 1456685 | 1/1974 | United Kingdom | 200/303 |

OTHER PUBLICATIONS

Square-D-*Control Systems Relays*-brochure.

General Electric Circuit Breaker Accessories, GE-H-4653A, 9/82.

Westinghouse Electric Corporation Low Voltage Breaker Division Instructions for Mounting Auxiliary Switch on FB, MCP and FB Magnetic Only Circuit Breakers, Feb. 1976, I.L. 13737-B.

*Primary Examiner*—Stephen Marcus

*Assistant Examiner*—Renee S. Luebke

*Attorney, Agent, or Firm*—Brumbaugh, Graves, Donohue & Raymond

[57] ABSTRACT

In the particular embodiments described in the specification, an attachment for a circuit breaker is mounted in an outer box which can be inserted into a recess in the cover of the circuit breaker case. The outer box has two guide projections which are received in channels in the cover and two projecting portions which interlock with corresponding portions on the circuit breaker housing.

2 Claims, 8 Drawing Figures

CIRCUIT BREAKER HOUSING AND ATTACHMENT BOX

BACKGROUND OF THE INVENTION

This invention relates to circuit breakers and, more particularly, to a new and improved circuit breaker having a separate box for a circuit breaker attachment.

It is often desirable for a circuit breaker assembly to contain not only the circuit breaker itself with its switching contacts and an operating assembly, but also one or more attachments such as a microswitch which is operated by actuation of circuit breakers to operate displays or alarms. Moreover, such an attachment should preferably be detached easily from the circuit breaker after it has been installed to permit alteration. Heretofore, such attachments have been constructed to be attached with screws or engaged in slots with openings before a cover is mounted on the circuit breaker.

With such arrangements, the cover of the circuit breaker must be removed to permit installation or replacement of an attachment on a circuit breaker that has already been adjusted and tested. In other words, such arrangements require the additional steps of removing and replacing the cover and, in addition, the switching mechanism and the adjusted tripping device of the circuit breaker are exposed. For this reason, greater care must be used and only skilled persons are qualified to do such work. On the other hand, if breakers are equipped with built-in attachments, they have to be handled separately from those which are not equipped therewith and the manufacturing process also must be different. Moreover, if attachments are to be replaced in such units, only skilled persons are permitted to do the work, which is disadvantageous since a substantial amount of time is required.

Accordingly, an object of the present invention is to provide a circuit breaker arrangement permitting an attachment containing a microswitch or the like to be attached or replaced without removing the cover of the circuit breaker or requiring special skill.

SUMMARY OF THE INVENTION

In accordance with the present invention, a circuit breaker arrangement includes a housing containing a circuit breaker and having a recess formed with channels and an outer box containing an attachment adapted to cooperate with a circuit breaker within the housing and the outer box has linear projections cooperating with the channels when the outer box is inserted in the recess. The attachment includes an operating element projecting through a hole in the housing within the recess to cooperate with the circuit breaker within the housing, and cooperative interlocking portions are provided on the housing and the outer box to releasably retain the outer box on the housing. With this arrangement, the attachment is readily attached and detached without removing the cover of the circuit breaker. Preferably, the cooperating interlocking portion of the housing is in its side wall so that cooperative interlocking can be achieved regardless of the relative sizes of the recess and the outer box.

BRIEF DESCRIPTION OF THE DRAWINGS

Further objects and advantages of the invention will be apparent from a reading of the following description in conjunction with the accompanying drawings, in which.

DESCRIPTION OF PREFERRED EMBODIMENTS

Figure 8:
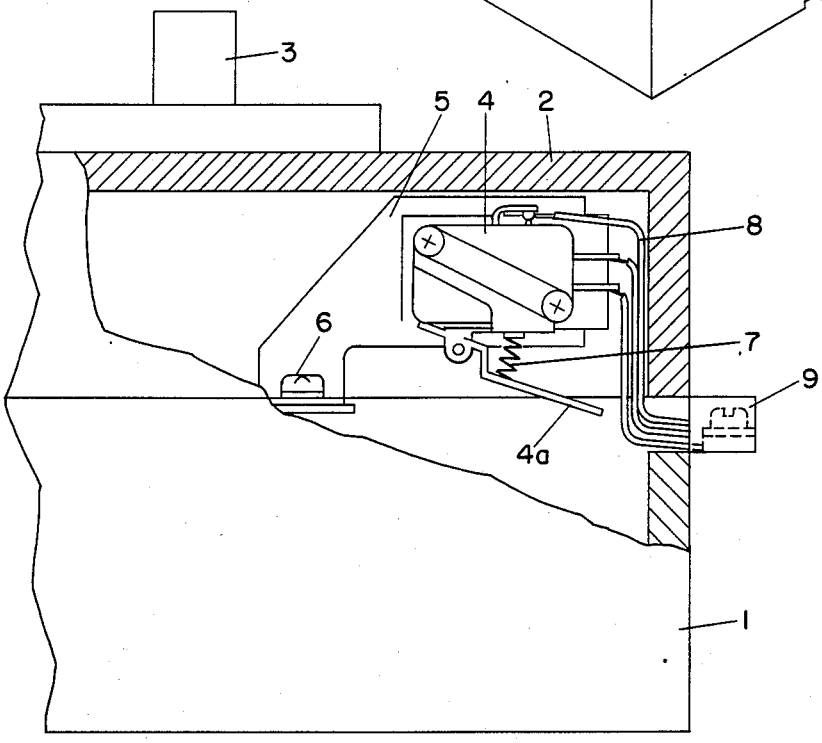
FIG. 8 (PRIOR ART)
FIG. 8 is a fragmentary view, partly broken away, showing a conventional arrangement for providing an attachment to a circuit breaker.

FIG. 8 illustrates a conventional circuit breaker arrangement in which a housing 1 has a switch handle 3 projecting from a cover 2. An attachment comprising a microswitch 4 is attached by screws 6 to the upper portion of the case through a base 5 and an actuator 4*a* is positioned to be operated by motion of the switching contacts of the circuit breaker (not shown). A reset spring 7 is interposed between the case of the microswitch and the actuator 4*a*. A lead 8 from the microswitch 4 is led out through a hole of the case 1 and is connected to a terminal plate 9.

When the circuit breaker operates to cause its moving contact to open, the actuator 4*a* will be moved so as to compress the spring 7 and cause the switch 4 to change position. On the other hand, when the circuit breaker is reset, the actuator 4*a* will be restored by the spring 7 and the switch 4 will also be reset.

Figure 1:
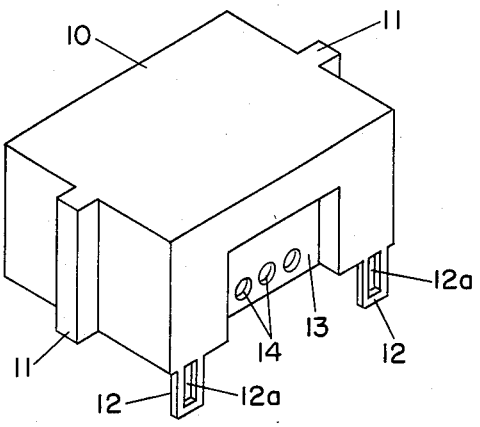
FIG. 1 is a perspective view illustrating the external appearance of an outer box containing an attachment in accordance with the present invention.

Referring now to FIGS. 1 through 7, representative embodiments of the present invention will be described in detail. FIG. 1 is a perspective view showing an outer box containing an attachment for a circuit breaker in accordance with the present invention. The outer box 10 is a cubic body molded from plastic and having an open bottom and parallel linear projections 11 on both side walls extending in the vertical direction. The box 10 also has two engagement sections 12 projecting downwardly from the front side wall at either end, the engagement sections 12 each having an engagement hole 12*a*. A recessed portion 13 is provided in the central portion of the front side wall with outlet openings 14 for lead wires. External terminals are mounted in the recessed portion 13 for lead wire connections.

Figure 2:
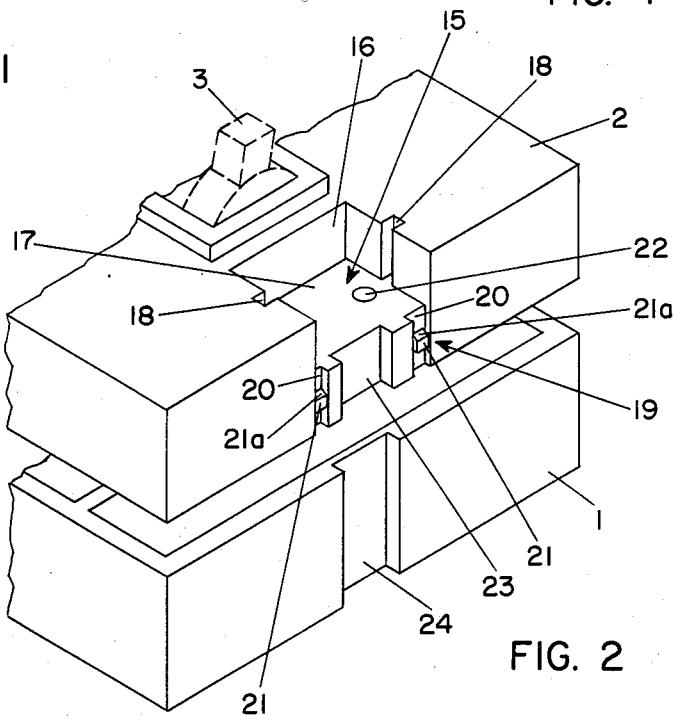
FIG. 2 is a fragmentary view illustrating a portion of the housing for a circuit breaker in accordance with the invention.

As shown in FIG. 2, a body cover 2 is arranged to receive the outer box 10. The body cover 2 is formed with a recessed portion 15 adjacent to a switch handle 3 which projects upwardly from the central portion of the cover 2 and the recess 15 has a side wall 16 and a bottom wall 17 to separate it from the interior of the circuit breaker housing. The side wall 16 is formed with two opposed channels 18 adapted to receive the linear projections 11 and the cover 2 also has two interlocking sections 19. Each interlocking section 19 consists of a channel 20 in the front side wall of the cover 2 adapted to receive the engagement section 12 of the outer box 10 and an interlocking projection 21 having a tilted face 21*a* positioned to engage the openings 12*a* in the engagement section 12. Moreover, a hole 22 is formed in the bottom wall 17 to communicate with the interior of the case 1. A recess 23 positioned between the interlocking sections 19 in the cover 2 is aligned with a recess 24 in the adjacent side wall of the case 1. These are useful when the arrangement is to be supported along a wall.

Figure 3:
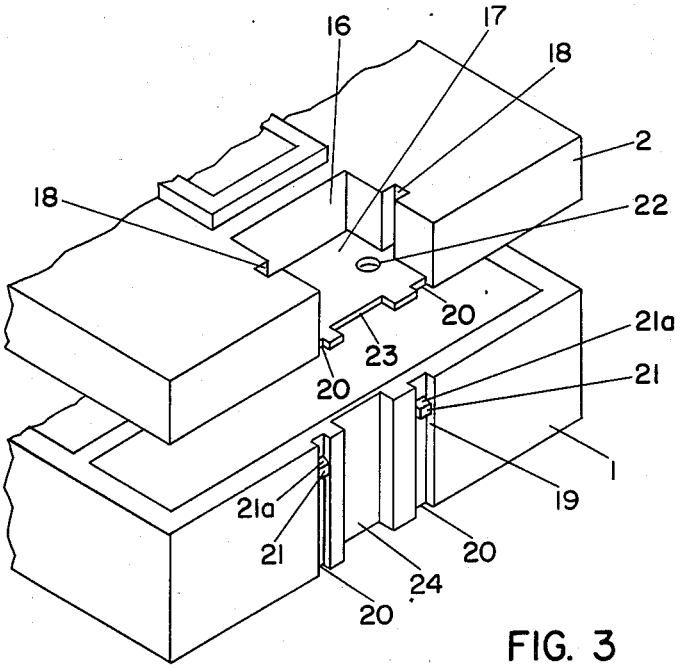
FIG. 3 is a fragmentary perspective view illustrating a portion of a different form of housing for a circuit breaker according to the invention.

In the embodiment shown in FIG. 3, each interlocking section 19 is formed in the case 1 rather than in the cover 2 and the channels 20 are formed in the side wall of the case 1, as well as the cover 2, so that the interlocking projections 21 having a tilted face 21*a* are formed in the case 1. The remainder of the case 1 and the cover 2 of the embodiment shown in FIG. 3 are the same as those shown in FIG. 2 except that the interlocking section 19 of the cover 2 has been transferred to the case 1.

Figure 4:
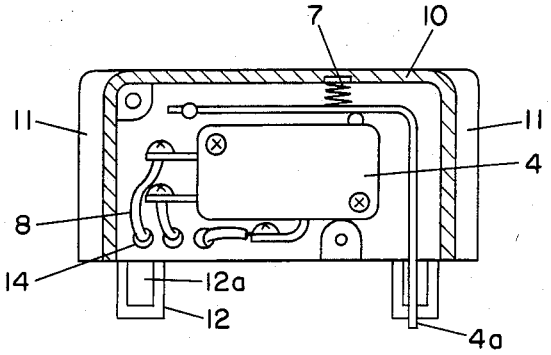
FIG. 4 is an elevational view in section showing the interior of the outer box of FIG. 1 containing a microswitch.

FIG. 4 illustrates a microswitch 4 mounted inside the above-described outer box 10 and fixed in such a manner that an actuator 4*a* projects downwardly from the box and a lead wire 8 is passed through the outlet opening 14 before the microswitch is installed. The reset spring 7 of the microswitch 4 is positioned between the actuator 4*a* and the wall of the outer box 10.

Figure 5:
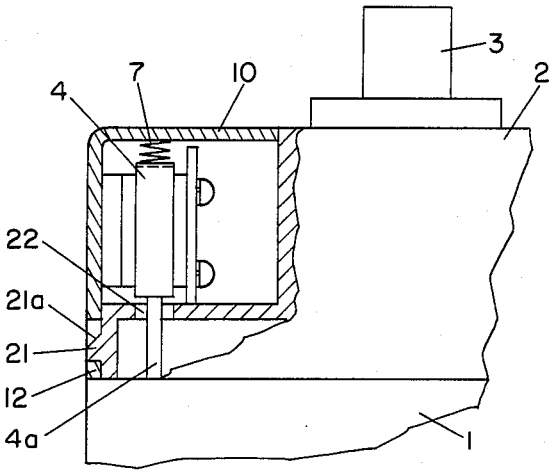
FIGS. 5 and 6 are fragmentary views, partly broken away, showing the outer box of FIG. 1 attached to the housings of FIGS. 2 and 3, respectively.

FIG. 5 shows the outer box 10 containing the microswitch 4 attached to the cover 2 of FIG. 2. When the linear projections 11 of the outer box 10 are inserted in the guide channels 18 of the recess 15 and the engagement sections 12 are inserted in the cut channels 20, the engagement sections 12 resiliently pass over the tilted faces 21*a* of the interlocking projections 21, so that the interlocking projections 21 firmly engage the holes 12*a* of the interlocking sections 12. When this is done, the actuator 4*a* extends through communicating hole 22 and is coupled to the moving part circuit of the breaker.

Figure 6:
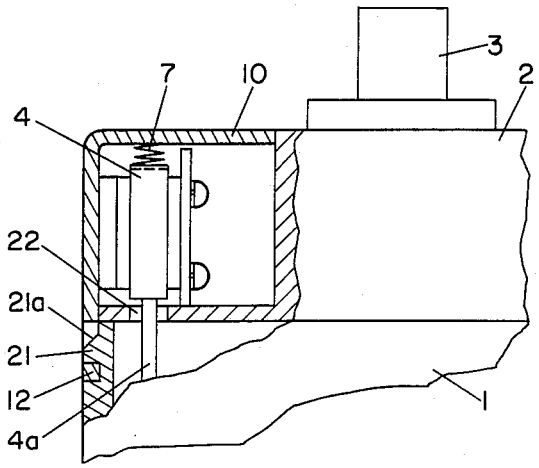

FIG. 6 shows the mounting of the outer box 10 containing the microswitch 4 on a body cover 2 and a case 1 of the type shown in FIG. 3. The arrangement is the same as that shown in FIG. 5 except that the engagement section 12 of the outer box 10 extends through the channel 20 of the cover 2 into the channel 20 of the case 1. This arrangement is preferable when circumferential wall of the cover 2 is low and an attachment to be mounted within the outer box 10 is large.

Figure 7:
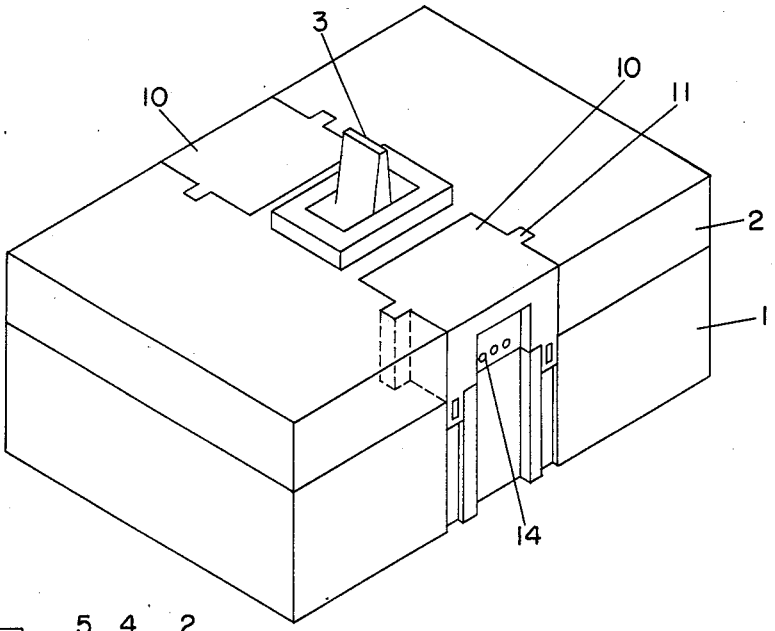
FIG. 7 is a perspective view of the circuit breaker arrangement of FIG. 6.

FIG. 7 illustrates the external appearance of the combination of the body cover 2 and the outer box 10 of FIGS. 3 and 6 combined together. As shown in FIG. 7, outer boxes 10 containing internal attachments may be installed on both sides of the handle 3 projecting from the cover 2 and corresponding lead wires are led out of corresponding outlets 14 therefor. If no attachments are to be used, empty outer boxes 10 may be mounted on the cover so as to not impair the external appearance thereof. Even if the communication hole 22 in the recess 15 is fairly large, no dust or the like can enter the breaker since the hole 22 is covered by the outer box. When an attachment is to be installed, it may be mounted in an empty outer box previously installed in the cover or that outer box may be exchanged for another in which the attachment has previously been mounted. Since the operation of the circuit breaker is the same as that of any conventional one, the description thereof is unnecessary.

We claim:

1. A circuit breaker assembly comprising;

an outer box enclosing an attachment having an operating element for the circuit breaker and having an open bottom, a closed top, a front wall and a pair of side walls, each side wall including a linear projection extending vertically and the front wall having a central recess, outlet openings for lead wires in said recess, and first and second engaging means, each including an engaging hole and each projecting downwardly at opposite ends of the front wall; and a circuit breaker housing comprising a cover portion and a case portion having an interior, the cover portion including a recess having an open top, a pair of side walls each provided with a linear channel, and a bottom wall which includes an opening, said outer box adapted to fit in the recess of the cover portion, the linear projections of the outer box fitting slidably in the channels of the side walls of the cover portion, the operating element of the attachment in the outer box adapted to extend through the opening in the bottom wall of the cover portion to the interior of the case portion, the front wall of the circuit breaking housing including a pair of channels each of which includes an interlocking projection, the pair of engaging means of the outer box adapted to fit into said pair of channels with the engaging holes accepting the interlocking projections.

2. The circuit breaker assembly of claim 1 in which the front wall of the circuit breaker housing has a recess which is designed to align with the central recess in the front wall of the outer box for forming a channel for the lead wires to the outlet openings in the outer box.

* * * * *